United States Patent [19]

Tepley

[11] Patent Number: 4,751,750

[45] Date of Patent: Jun. 21, 1988

[54] GLOVE

[75] Inventor: George L. Tepley, Chattanooga, Tenn.

[73] Assignee: TGC Corporation, Chattanooga, Tenn.

[21] Appl. No.: 66,729

[22] Filed: Jun. 26, 1987

[51] Int. Cl.[4] ..... A41D 19/00

[52] U.S. Cl. ..... 2/161 R; 2/169

[58] Field of Search ..... 2/169, 161 R, 161 A, 2/159, 164

[56] References Cited

U.S. PATENT DOCUMENTS

| | | | |
|---|---|---|---|
| 1,525,999 | 2/1925 | King et al. | 2/169 |
| 1,875,441 | 9/1932 | Gillian | 2/169 |
| 2,074,893 | 3/1937 | Dunn | 2/169 |
| 2,168,819 | 8/1939 | Dunn | 2/169 |
| 2,427,170 | 9/1947 | Wells | 2/169 X |
| 2,596,349 | 5/1952 | Thurlow et al. | 2/169 |
| 2,785,412 | 3/1957 | Zelenka | 2/169 |
| 3,151,334 | 10/1964 | Haupt et al. | 2/169 |
| 3,251,067 | 5/1966 | Shmikler | 2/169 |

*Primary Examiner*—Louis K. Rimrodt
*Assistant Examiner*—J. L. Olds
*Attorney, Agent, or Firm*—Berman, Aisenberg & Platt

[57] ABSTRACT

A glove comprising a palm piece including a thumb portion having a longitudinal axis extending substantially parallel to a lower edge of the glove, a first finger portion and a fourth finger portion, and a straight linear cut connecting the base of the first finger portion and the fourth finger portion at an angle of between about 21° and 25° to a line parallel to the lower edge of the glove, a back thumb piece, a back piece including first, second, third, and fourth back finger portions, and a middle piece including second and third finger portions are attached together to provide a glove particularly conformed to the shape of the working hand, the hand in action, the hand as it is naturally means to be used.

16 Claims, 3 Drawing Sheets

FIG. 1
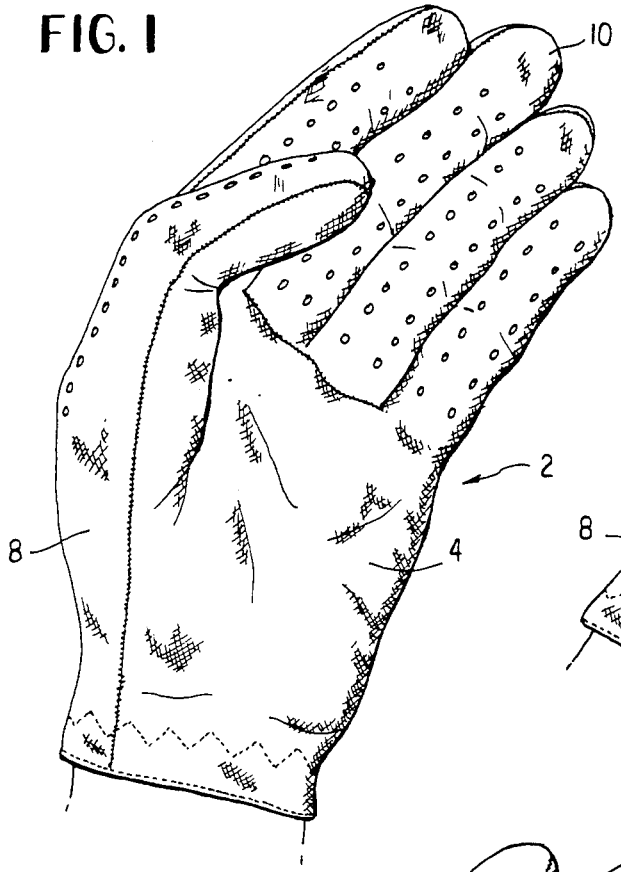
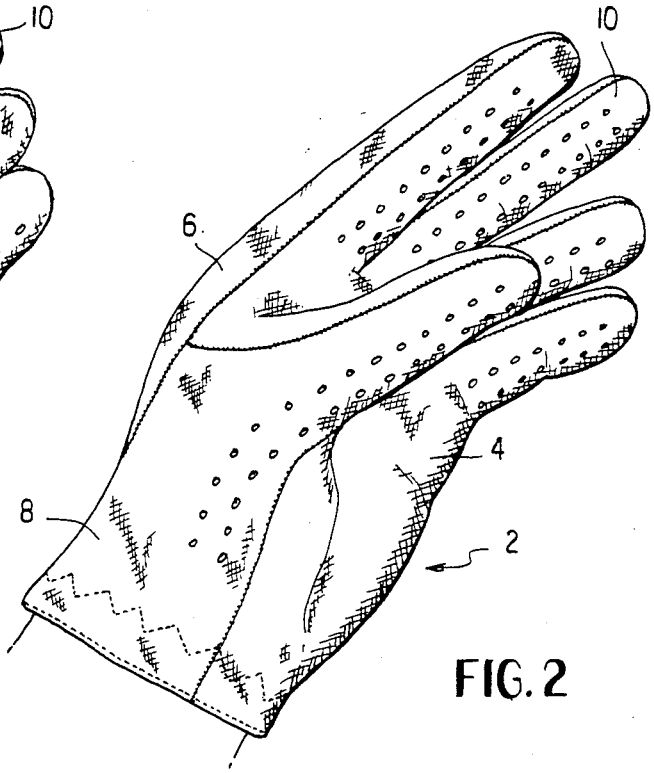
FIG. 2
FIG. 3
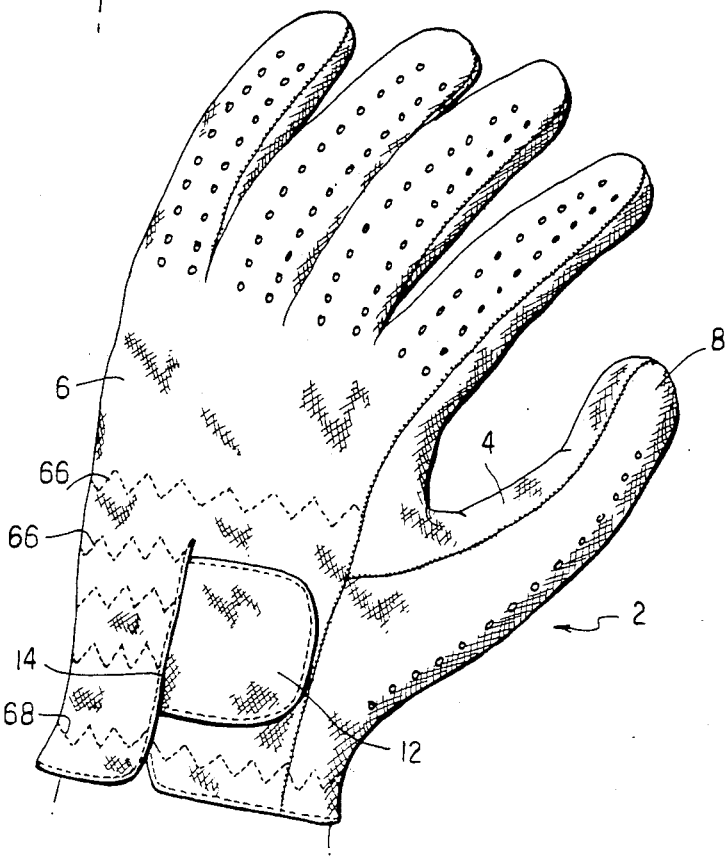

GLOVE

FIELD OF THE INVENTION

The invention relates to gloves, particularly gloves designed for the working hand.

BACKGROUND OF THE INVENTION

It is important to have a glove which conforms to the natural configuration of the hand at work and does not bind or constrict the hand and which lends itself to the natural movement of the hand but is sufficiently tight fitting that excess folds of leather do not impede the grip of the working hand.

Different designs of gloves are well known in the art. Raymond, U.S. Pat. No. 905,365, shows a gunn-cut glove having a palm piece including a thumb, first and fourth fingers, in which the portions for the first and fourth fingers are separated by a V-shaped cut and the front portions of the second finger and third finger are separate pieces. The Dunn patent, U.S. Pat. No. 2,074,893, shows another gunn-cut glove having a palm piece including a thumb portion and a portion for the first and fourth fingers. The first and fourth fingers are separated by an angled cut, the front portions of the second and third fingers are in one piece. The thumb portion is cut extending downwards in the pattern piece, which is economical of fabric, but causes the thumb to rest awkwardly against the first finger with a fold of fabric therebetween.

The glove of the Jones patent, U.S. Pat. No. 1,922,095, shows another gunn-cut glove in which the angle between the first and fourth fingers is V-shaped and the thumb portion is cut at an angle which causes the fabric to fold between the thumb and palm of the glove. The glove of the Spivak patent, U.S. Pat. No. 1,179,572, is a gunn-cut glove in which the front and back portions of the glove are cut in one piece, greatly constraining hand movement. Haupt et al., U.S. Pat. No. 3,151,334, shows another gunn-cut glove in which the thumb piece has many seams, causing binding and discomfort to the wearer. The Lindfelt patent, U.S. Pat. No. 1,815,412, shows a handball glove in which the back of the glove is cut with a U-shaped opening, having edges of the opening buckled together.

The patent to Ertl, U.S. Pat. No. 4,559,646, describes a work glove having a padded fabric lining. The thumb portion is cut with a downward orientation as in the glove of Dunn. The patent to Connelly, U.S. Pat. No. 4,245,357, shows another glove having a thumb piece with a downward orientation. The glove is cut on a gunn pattern having curved seams at the base of the first and fourth fingers, and likewise having curved edges seamed therewith on the second and third fingers.

SUMMARY OF THE INVENTION

The glove of the invention is a particularly well-fitting working-hand glove which conforms closely to the natural shape of the hand in action, allowing the hand to be comfortably moved, without the restraint found in the constricting designs of the past, and greatly reduces binding and interference from excess folds of leather. The glove fits closely, is ventilated for comfort, and provides good wear characteristics due to the designed elimination of tension when covering the hand at work - whether such effort is expended on the sports field, golf course, behind the wheel of a car, the factory floor, or any other time one wears this glove.

It is an object of the invention to provide a glove for a working hand.

BRIEF DESCRIPTION OF THE DRAWINGS

FIG. 1 is a front elevational view of a glove of the invention.

FIG. 2 is a side elevational view of the glove of FIG. 1.

FIG. 3 is a back elevational view of the glove of FIG. 1.

DETAILED DESCRIPTION OF THE INVENTION

Figure 4:
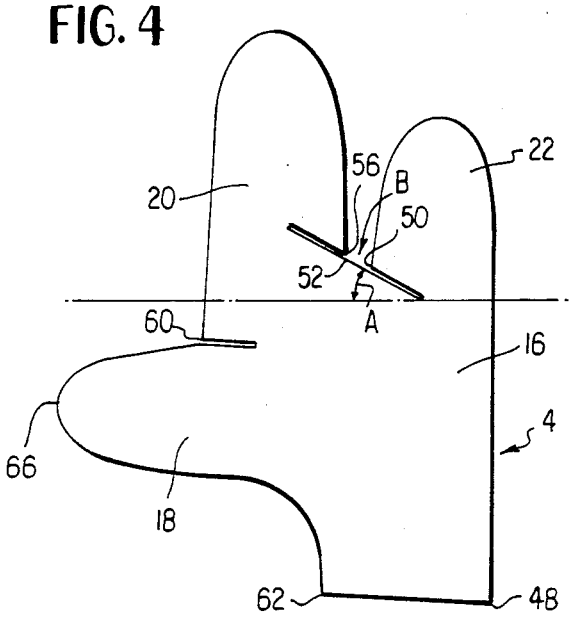
FIG. 4 is a top plan view of a palm piece for a left glove of the invention.

It is important to have a glove which conforms to the natural configuration of the hand at wrok and does not bind or constrict the hand and which lends itself to the natural movement of the hand but is sufficiently tight fitting that excess folds of leather do not impede the grip of the working hand.

The glove of the invention may be used whenever gloves are worn, and is particularly useful for wearing when playing sports, for example, for golf, handball or tennis, or for driving a vehicle. The glove fits the working hand closely and follows the natural contour of the hand, eliminating binding and excess folds of material found in gloves which do not conform and are not intended to conform to the shape of the working hand.

The glove is exceptionally comfortable to wear since the shape of the hand is followed. Moreover, the glove has few seams, compared to a traditional glove, further enhancing comfort.

A glove of the invention includes a plam piece with a thumb portion having a longitudinal axis extending substantially parallel to a lower edge of the glove, a first finger portion and a fourth finger portion, and a straight linear cut connecting the base of the first finger portion and the fourth finger portion at an angle of between about 19° to 27°, and preferably of between about 21° to 25° to a line parallel to the lower edge of the glove. A back thumb piece, a back piece including first, second, third, and fourth back finger portions, and a middle piece including second and third finger portions are attached together and to the palm piece to provide a glove particularly conformed to the shape of the hand, and particularly suitable for sports use.

With reference to FIGS. 1 to 6 in which like numerals represent like parts, glove 2 is exemplified as a golf glove, but is equally suitable for general wear, or for playing handball, tennis, or other sports. The glove is illustrated as a glove for a left hand; a right hand glove is the mirror-image of a left hand glove. Glove 2 is made from four pieces, a plam piece 4, a back piece 6, a back thumb piece 8 and a middle piece 10. A tab 12 may optionally join two sides of slit 14 in back piece 6. The seams of glove 2 do not interfere with the movement of the hand and do not cause binding as opposed to a traditionally cut glove in which the thumb piece has a seam around the base of the thumb which causes binding when the thumb moves and which has excess material in the palm of the glove.

According to the glove of the invention, the thumb piece is seamed up the front side of the glove, over the top of the thumb and down the other side edge of the thumb to meet the vertical side of the back piece about halfway up the back of the hand. There are no front seams to the glove in the thumb region. The back piece, comprising a back portion and four finger portions, has a seam down the outside edges of the first finger and fourth finger joining the back piece to the thumb and palm pieces. The palm piece comprises front sections of the thumb and the first finger and fourth fingers. The middle piece, having second and third finger portions, is attached to the back portion around the back outside edges of these fingers, and is attached to the palm piece at the base of these two fingers.

Figure 5:
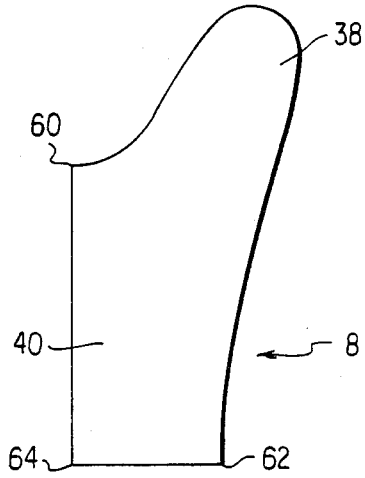
FIG. 5 is a top plan view of a back thumb piece of a left glove of the invention.
Figure 6:
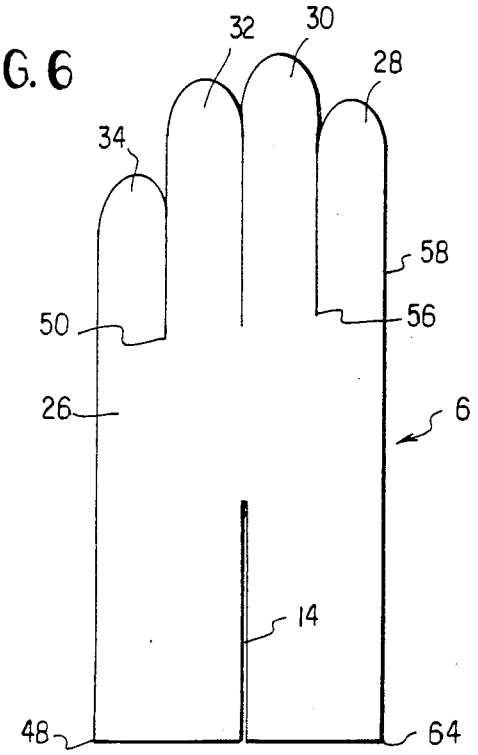
FIG. 6 is a top plan view of a back piece of a left glove of the invention.
Figure 7:
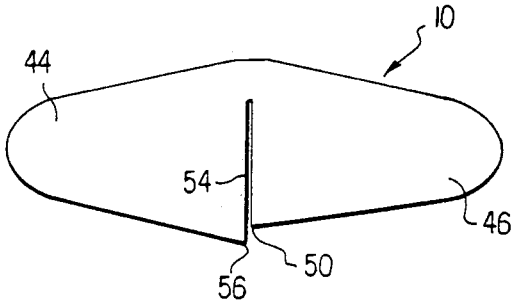
FIG. 7 is a top plan view of a piece for the second and third fingers of a left glove of the invention.

FIG. 4 shows palm piece 4 in detail. Palm piece 4 has thumb portion 18 cut to extend horizontally from palm portion 16. The palm piece further includes first finger portion 20 and fourth finger portion 22. FIG. 5 shows back thumb piece 8 which has a thumb portion 38 and a back portion 40. FIG. 6 shows back piece 6 having a back portion 26, a first finger portion 28, a second finger portion 30, a third finger portion 32 and a fourth finger portion 34. FIG. 7 shows middle piece 10 having a second finger piece 44 and third finger piece 46.

The glove pieces are attached together, preferably by stitching, seaming palm piece 4 to back piece 6 along the side of the fourth finger from the lower edge 48 of the glove up the outside edge of the glove, and along the side, top and inside back edge of the fourth finger to corner 50. At corner 50, middle piece 10 is also joined to palm piece 4 along the length of cut 52 in palm piece 4 which is joined to cut 54 in middle piece 10. Palm piece 4 and middle piece 10 are stitched together up to corner 56 at the opposite ends of lines 52 and 54 of palm piece 4 and middle piece 10. Corner 56 is at the base of first finger 28 of back piece 6. Palm piece 4 and back piece 6 are attached together from corner 56 up the edge of first finger portion 28, over the top of the first finger, and down edge 58 of first finger portion 28 to corner 60 on palm piece 4. At corner 60, also shown on FIG. 5, back thumb piece 8 is attached to back piece 6 and palm piece 4, and a seam follows the contour of the thumb attaching palm piece 4 to back thumb piece 8, the stitching continuing to the lower edge of the glove at corner 62. Back piece 6 and back thumb piece 8 are attached together over the remaining distance to the lower edge corner 64 of back piece 6 of the glove.

A particular feature of the glove of the invention is cut 52, positioned at an angle A, shown in FIG. 4, of about 19° to 27°, preferably about 21° to 25° to a line parallel to the lower edge of the glove. Angle A is most preferably about 23°. This angle decreases tension from the glove itself by allowing the glove to conform to the contour of the working hand, closely following the natural form of the hand in action enabling increased comfort in wear. An angle of cut, preferably of about 21° to 25°, allows the hand to close down naturally without restricting or binding the fingers, and without excess leather in the palm and finger area, providing a snug fit throughout the one-piece palm/front thumb portion 4. The cut of the glove avoids tension in the plam or in the back of the hand. Seams are placed on the back portion of the glove, adjacent the back of the hand only and constrict hand movement less than seams on the front of the glove (as conventionally used). The glove of the invention also avoids pressure on the fingertips, commonly found in a conventional glove in which the finger pieces are separate and have two seams, at the front edge and back edge of each finger.

Figure 8:
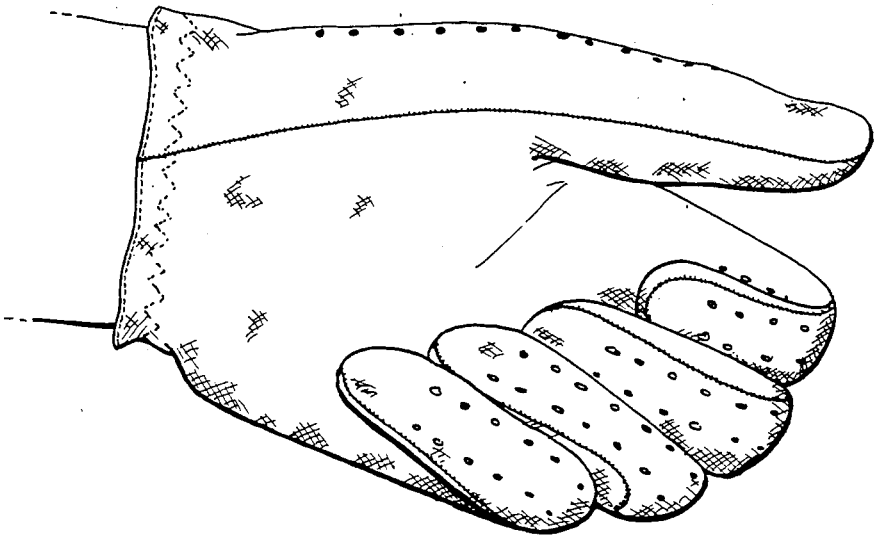
FIG. 8 is a front elevational view of a glove of the invention worn in the working hand position.
Figure 9:
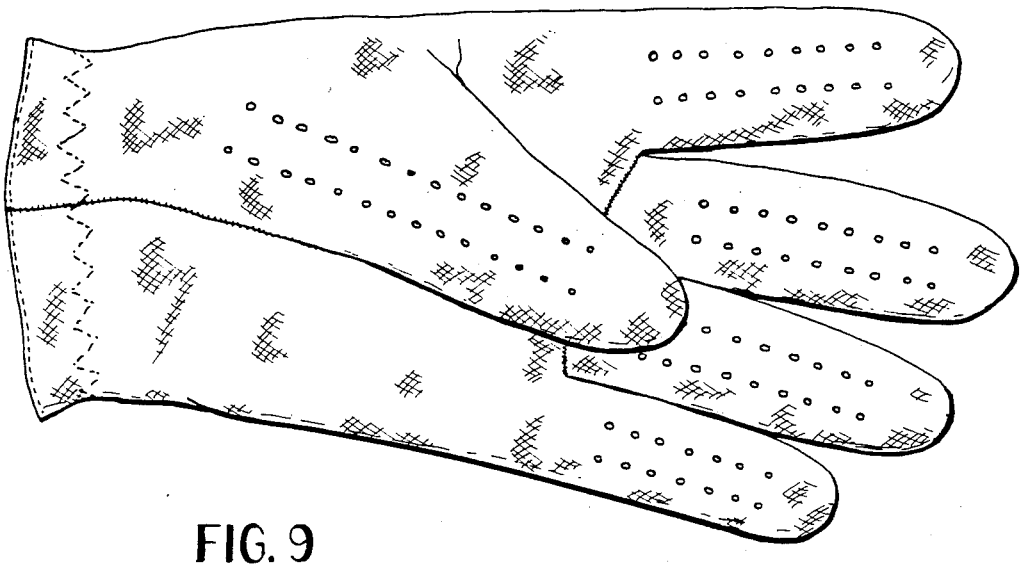
FIG. 9 is a front plan view of a glove.

Moreover, in existing glove design, the front thumb portion is cut to point straight upwards toward the first finger. In the glove of the invention, the thumb is cut horizontally from palm piece 4 and when the hand is flexed, for example, when gripping a golf club, the thumb moves naturally towards the third finger, which is the path of least resistance thus providing mobility through the palm and facilitating natural closing of the working hand. FIG. 8 shows a glove 2 in the working hand position, as if about to grip an article, such as a golf club or steering wheel of a vehicle. Tip 66 of thumb portion 18 of palm piece 4 naturally identifies with the space between first finger portion 20 and fourth finger portion 22, shown in FIG. 4, and shown on a glove 2 in FIG. 9 which clearly illustrates the identification of the thumb of the glove with the third finger, to follow the natural closing motion of a hand.

The glove may further include a fastening, such as tab 12 shown in FIG. 3, extending across slit 14. The fastening may be secured in any conventional manner, such as by using an adhesive hook and loop fastening, such as VELCRO (VELCRO is a trademark of Velcro USA, Inc.), or by using snap fasteners, or the sides of the slit may be joined by a zipper or by other means known to one skilled in the art.

The back of the glove of the invention may also be provided with at least one row of elastic 66 applied by stitching, or other means, as shown in FIG. 3. A row of elastic 68 is applied around the bottom edge of the glove, as shown in FIGS. 1 to 3, providing a snug fit around the wrist. Perforations for ventilation, for example, in back piece 4, may optionally be used, as illustrated in FIGS. 1 to 3, andand/or thumb piece 8, as known to one skilled in the art.

The glove is suitably made of sheepskin, kidskin or other soft leather materials. A preferred material is cabretta (a type of sheepskin). Woven or unwoven fabrics may also be used. The glove may be used for golf, tennis, baseball, handball, driving, or for general purposes, such as for a dress glove.

While the invention has been described above with respect to certain embodiments thereof, it will be appreciated that variations and modifications may be made without departing from the spirit and scope of the invention.

What is claimed is:

1. A glove comprising:

a palm piece including a first finger portion and a fourth finger portion, and a straight linear cut connecting the base of the first finger portion and the base of the fourth finger portion, said straight linear cut extending at an angle of about 19° to 27° to a line parallel to a lower edge of the glove.

2. A glove of claim 1 wherein the palm piece further comprises a thumb portion having a longitudinal axis extending substantially parallel to a lower edge of the glove.

3. A glove of claim 2 further comprising a bach thumb piece attached to the thumb portion of the palm piece.

4. A glove of claim 3 further comprising a back piece including first, second, third and fourth finger portions, said back piece attached to its sides to the palm piece and the back thumb piece.

5. A glove of claim 4 further comprising a middle piece including second and third finger portions attached to the palm piece and the back piece.

6. A glove of claim 5 wherein the middle piece further comprises a slit extending a substantial distance from one edge between said second and third finger portions, the length of said slit being attached to said palm piece through the length of the straight linear cut from an inner corner of the base of the first finger to an inner corner of the base of the fourth finger.

7. A glove of claim 1 wherein the straight linear cut extends at an angle of about 21° to 25° to a line parallel to the lower edge of the glove following the natural slope of the working hand.

8. A glove of claim 7 wherein the straight linear cut extends at an agnle of about 23°.

9. A glove of claim 4 further comprising a slit in said back piece extending from about the middle of the lower edge of the back piece toward the fingers in a direction substantially perpendicular to the lower edge.

10. A glove of claim 9 further comprising a means for fastening across the slit.

11. A glove of claim 10 wherein the means for fastening comprises a tab attached to the glove on one side of the slit and securable to the glove on the other side of the slit.

12. A glove of claim 4 wherein the back piece further comprises stretchable means for providing a close fit of the glove to the hand.

13. A glove of claim 12 wherein the stretchable means comprises at least one row of elastic.

14. A glove of claim 1 wherein the glove further comprises stretchable means extending adjacent the lower edge of the glove for providing a close fit of the glove to the hand.

15. A glove of claim 14 wherein the stretchable means comprises elastic.

16. A glove comprising:

a plam piece including a thumb portion having a longitudinal axis which extends substantially parallel to a lower edge of the glove, a first finger portion and a fourth finger portion, a back thumb piece attached to the thumb portion of the palm piece, a back piece including first, second, third and fourth finger portions, said back piece attached to the back thumb piece and the palm piece, and a middle piece including front and side sections of second and third finger portions attached to the palm piece along the length of a slit between the second and third finger portions, and attached to the back piece along the remainder of the perimeter of the middle piece, wherein the base of the finger portion and the base of the fourth finger portion of said palm piece are connected by a straight line cut angled at between 21° and 25° to a line parallel to the lower edge of the glove, said straight line cut extending across the base of the second and third fingers, said middle piece being stitched to said straight line cut.

* * * * *